US011060828B1

(12) United States Patent
Gemmrig

(10) Patent No.: US 11,060,828 B1
(45) Date of Patent: Jul. 13, 2021

(54) DOUBLE SHOULDER ANGLE FIREARM CARTRIDGE AND CHAMBER FOR AR-15, BOLT RIFLES, PISTOLS, AND OTHER FIREARMS

(71) Applicant: Richard J. Gemmrig, Selma, OR (US)

(72) Inventor: Richard J. Gemmrig, Selma, OR (US)

( * ) Notice: Subject to any disclaimer, the term of this patent is extended or adjusted under 35 U.S.C. 154(b) by 0 days.

(21) Appl. No.: 16/891,365

(22) Filed: Jun. 3, 2020

Related U.S. Application Data

(60) Provisional application No. 62/868,173, filed on Jun. 28, 2019.

(51) Int. Cl.
*F42B 5/28* (2006.01)
*F42B 5/02* (2006.01)

(52) U.S. Cl.
CPC ..... *F42B 5/28* (2013.01); *F42B 5/025* (2013.01)

(58) Field of Classification Search
CPC ..... F42B 5/28; F42B 5/025
USPC ..... 102/464
See application file for complete search history.

(56) References Cited

U.S. PATENT DOCUMENTS 3,209,691 A * 10/1965 Herter ..... F42B 5/28 102/464
6,354,221 B1 3/2002 Jamison
6,595,138 B2 7/2003 Jamison
7,011,028 B1 3/2006 Emary
7,316,093 B2 1/2008 Knightlinger
8,011,301 B1 9/2011 Sloan
8,443,729 B2 3/2013 Mittelstaedt
8,869,702 B2 10/2014 Padgett
8,875,633 B2 11/2014 Padget
9,372,054 B2 6/2016 Padgett
9,404,719 B1 * 8/2016 Bowers ..... F42B 5/025
9,995,561 B2 6/2018 Padgett
2004/0074412 A1 4/2004 Knightlinger
2016/0216088 A1 * 7/2016 Maljkovic ..... F42B 5/28
2016/0245630 A1 * 8/2016 Kedairy ..... F42B 5/26
2017/0038182 A1 * 2/2017 Kedairy ..... F42B 5/025
2018/0306558 A1 * 10/2018 Padgett ..... F42B 5/30

* cited by examiner

*Primary Examiner* — Samir Abdosh
(74) *Attorney, Agent, or Firm* — Jerry Haynes Law

(57) ABSTRACT

A double shoulder angle firearm cartridge for AR-15, bolt action rifles, pistols, and any other firearm includes a firearm cartridge comprising a case that holds a primer, powder, and bullet. The case is defined by a case head forming a rim and an extractor groove, a body section extending from the case head, at least two shoulder angles extending from the body section, and a neck section extending from the shoulder angles. The shoulder is defined by at least two angles tapering into each other in an integral configuration. The first angle is 30°; and the second angle being a 17° 30' shoulder angle, substantially the same as the 7.62×39 Russian round. The diameter of the case is approximately 0.447 inches. The length of the case is approximately 1.530 inches.

14 Claims, 2 Drawing Sheets

DOUBLE SHOULDER ANGLE FIREARM CARTRIDGE AND CHAMBER FOR AR-15, BOLT RIFLES, PISTOLS, AND OTHER FIREARMS

CROSS-REFERENCES TO RELATED APPLICATIONS

This application claims priority from U.S. Provisional Application Ser. No. 62/868,173, entitled "Double Shoulder Angle Firearm Cartridge and Chamber for AR-15 and Bolt Rifles and Pistols", filed on Jun. 28, 2019 which application is hereby incorporated herein by reference in its entirety.

FIELD OF THE INVENTION

The present invention relates generally to a double shoulder angle firearm cartridge for AR-15, bolt action rifles, and pistols. More so, the present invention relates to a firearm cartridge comprising a case that holds a primer, powder, and bullet; and the case is defined by a case head forming a rim and an extractor groove, a body section extending from the case head, at least two angles extending from the body section, and a neck section extending from the shoulder; whereby the angles taper into each other in an integral configuration, and are defined by at least two angles with the first angle, is 30°, and the second angle substantially the same as the 7.62×39 Russian round being a 17° 30' shoulder angle.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Rifle cartridges shoulders for controlling the cartridges headspace are known in the art. In some cases, rifle cartridge cases have two shoulders which may allow for additional burning of the charge within the cartridge case, and thus produce greater muzzle velocity. The following paragraphs describe the state of the prior art.

U.S. Pat. No. 3,209,691 to Herter discloses a rifle cartridge case with a double shoulder structure adjacent the projectile-receiving neck of the case, the double shoulder structure for causing maximum burning of the charge within the case so that a greater muzzle velocity is produced without requiring an increase in the amount or type of the powder charge.

U.S. Pat. No. 6,354,221 to Jamison describes a firearm cartridge case having two substantially cylindrical portions of significantly different diameters interconnected by a frusto-conical shoulder portion. The case has a ratio of its overall length to its diameter, at a location 1.25 inches from its base, of no more than about 4.2, giving it an unusually short, fat profile.

U.S. Pat. No. 6,595,138 to Jamison describes a firearm cartridge case wherein the overall length of the cartridge case has a ratio to a diameter thereof, at a predetermined location on a wide portion of the case, of no more than about 4.2. Such diameter is at least about 0.53 inch, and the length of the wide portion of the case has a ratio to such diameter of no more than about 3.33.

U.S. Pat. No. 7,011,028 to Emary describes a firearm cartridge with a rimmed metal case having a body portion having a rim and a cylindrical wall portion adjacent to the rim. The body portion has dimensions corresponding to a 22 Long Rifle specification. The case has a tapered shoulder portion contiguous with the first portion, and a neck portion contiguous with the shoulder portion and a defining a mouth.

U.S. Pat. No. 7,316,093 to Kightlinger describes a cartridge and a barrel insert for a firearm adapted to fire munitions comprising a 223 round. The cartridge has an axis, a neck, a shoulder, a body, an extraction groove, and a slight frustoconical shape extending axially from the widest body diameter to the beginning of the shoulder.

U.S. Pat. No. 8,011,301 to Sloan discloses a cartridge case for a firearm formed to contain a .338 caliber bullet. The case includes a cylindrical body portion with a central aperture in the head end for receipt of a primer and a cartridge extraction groove formed around the periphery of the body portion adjacent the head end. A frusto-conical shoulder portion tapers radially inwardly from the body portion and a generally cylindrical neck portion extends longitudinally from the shoulder portion.

U.S. Pat. No. 8,443,729 to Mittelstaedt describes a centerfire rifle cartridge with a case having a head having a rim, a body extending from the head to a tapered shoulder, and a neck extending from the shoulder and defining a mouth receiving a bullet. The body has a straight external surface free of a protruding belt, and has a maximum diameter sized to closely fit for operation within a standard action of magnum width.

U.S. Pat. No. 8,869,702 to Padgett discloses a high strength polymer-based cartridge casing including a first end having a mouth and a neck extending away from the mouth, a shoulder extends below the neck and away from the first end, an inside of the shoulder can be shaped in at least one of a convex or concave shape. The shoulder can have unequal outside and inside shoulder angles.

U.S. Pat. No. 8,875,633 to Padgett discloses a high strength polymer-based cartridge casing that can have a frangible portion capable of being split upon discharge of a projectile.

U.S. Pat. Nos. 9,372,054 and 9,995,561 to Padgett disclose a high strength polymer-based cartridge casing that includes a cartridge body, molded from a polymer, having a first end and an opposing second end, and enclosing a volume. A bullet is removably engaged with the first end and an insert is engaged to the second end.

U.S. Patent Application No. 2004/0074412 to Kightlinger describes a cartridge and a chamber for a firearm adapted to fire a bullet with an outside diameter of about 0.223". The cartridge has an axis, a neck, a shoulder, a body, and an extraction groove. The shoulder and the shoulder bore may be formed at an angle where the angle is about 28°, ±3° with respect to the axis of the cartridge or chamber.

U.S. Patent Application No. 2016/0245630 and U.S. Patent Application No. 2017/0038182 to Kedairy describe a .30 caliber cartridge that provides a centerfire cartridge with a case having a head with a rim, a body extending from the head to a tapered shoulder to a mouth that seats a bullet. The cartridge having a dimension that is short enough to fit in an automatic pistol's magazine and when fired from such a pistol's barrel will achieve ballistics closely resembling that of a rifle carbine.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
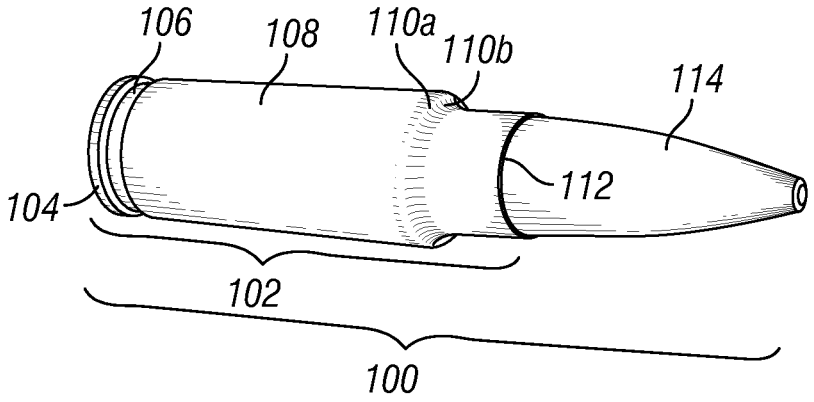
FIG. 1 illustrates an upright perspective view of an exemplary double shoulder angle firearm cartridge for AR-15 and bolt rifles, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A double shoulder angle firearm cartridge 100 for AR-15 and other action rifles is referenced in FIGS. 1-4. Those skilled in the art will appreciate that the cartridge is suitable for use in all types of rifles and pistols, including automatic, semi-automatic, bolt action, lever action, and pump action rifles as well as automatic, semi-automatic, and revolver handguns. The firearm cartridge 100 comprising a case 102 that holds a primer, powder, and bullet 114. The case 102 is defined by a case head 104 forming a rim and an extractor groove 106, a body section 108 extending from the case head 104, at least two shoulder angles 110*a*, 110*b* extending from the body section 108 and a neck section 112 extending from the shoulder angles 110*a-b*.

The novel aspect of the invention are the at least two shoulder angles 110*a-b* tapering into each other in an integral configuration. The shoulder is defined by at least two angles with the first angle being approximately 30 degrees; and the second angle forming a more gradual 17° 30' sloped shoulder, substantially the same as the 7.62×39 Russian round.

From and starting at the case head 104, the body section 108 tapers down to the first angle which is 30° and then into the second angle of the 7.62×39 Russian angle of 17°-30'. This arrangement centers and head spaces the Russian round while the first angle of 30° head spaces the Yahweh round and reduces case length growth.

In one non-limiting embodiment, the body section 108 is generally cylinder-shaped and has an approximately constant diameter (i.e. the diameter does not change at any point by more than 0.016 inches) between the case head 104 and the shoulder angles 110*a-b*.

Those skilled in the art will appreciate that a 7.62×39 Russian cartridge may be chambered and fired interchangeably from a firearm having the cartridge 100 chamber similar to how a .38 caliber round may be interchangeably chambered and fired with a .357 Magnum firearm.

One aspect of a double shoulder angle firearm cartridge 100 for AR-15 and bolt rifles, shown in FIG. 1 comprises:

- a case 102 configured to hold a primer, a powder, and a bullet 114,
- the case 102 being defined by a case head 104 forming a rim and an extractor groove 106, a body section 108 extending from the case head 104, at least two shoulder angles extending from the body section 108, and a neck section 112 extending from the shoulder,
- the shoulder defined by at least two angles with the first angle being sloped from the case head 104 to the neck section 112 from about 16° to 44°, and the second shoulder 110*b* being sloped from the case head 104 to the neck section 112 from about 3°-30' to 31°-30',
- the case 102 further being defined by a headspace gauge of about 7.62×39 millimeters,
- the case 102 having a length of approximately 1.530 inches,
- the case 102 further having a diameter of approximately from 0.437 to 0.454 inches; and
- a chamber of a firearm for carrying the case during discharge.

In another aspect, the first part of the shoulder 110*a* angle slopes from the case head 104 to the neck section 112 about 30°.

In another aspect, the second part of the shoulder 110*b* slopes from the case head 104 to the neck section 112 about 17°-30'.

In another aspect, the diameter of the case 102 is approximately 0.447 inches, with an exemption for Sporting Arms and Ammunition Manufacturers' Institute (SAAMI) approved cartridge 100*s*, as of the date of filing of this patent application. See https://saami.org for information regarding SAAMI approved cartridges.

In another aspect, the length of the case 102 is approximately from 1.453 to 1.603 inches.

One objective of the present invention is to provide a rifle cartridge 100 that travels approximately 400-700 feet per second faster in regards to velocity, and at a faster velocity than a 7.62×39 Russian cartridge 100 known in the art.

Another objective is to provide a cartridge 100 that is interchangeable between AR-15 and other firearms.

Yet another objective is to provide a cartridge 100 for both hunting and military use.

Yet another objective is to provide an inexpensive to manufacture firearm cartridge.

Figure 2:
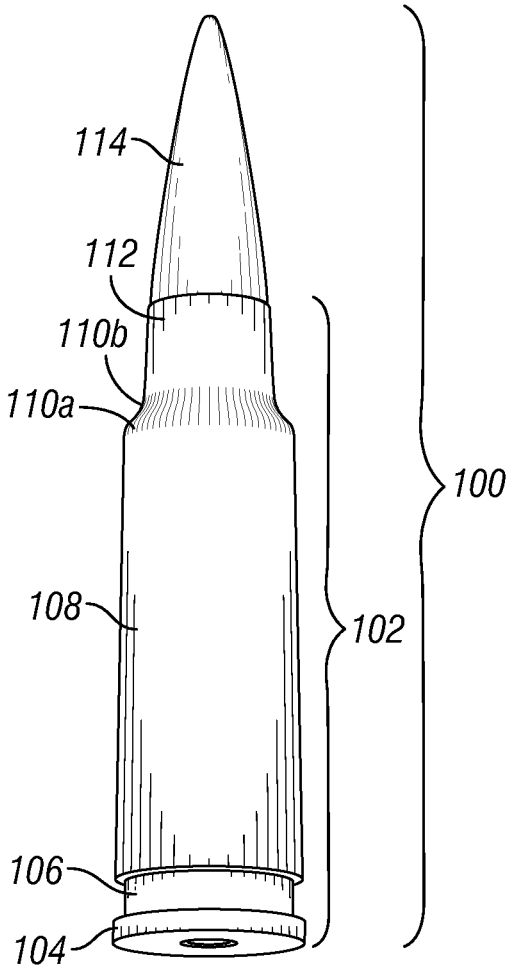
FIG. 2 illustrates a lengthwise perspective view of the double shoulder angle firearm cartridge, in accordance with an embodiment of the present invention.

As referenced in FIG. 2, the double shoulder angle firearm cartridge 100 may include a centerfire cartridge known in the art. The cartridge 100 is one that discharges from a firearm; and specifically from a chamber of a firearm used for carrying a case 102 of the cartridge 100 during discharge. Thus, the present invention also covers a chamber (not shown) of a firearm sized and dimensioned to carry the cartridge and case during discharge. In one non-limiting embodiment, the chamber is .30 caliber or up to 0.317 inches in diameter.

In some embodiments, the cartridge 100 comprises a case 102. The case 102 is configured to hold a primer, a powder, and a bullet 114. In one embodiment, the case 102 has a cylindrical shape, and is fabricated from a metal known in the art of cartridges. The primer is a compound that explodes when struck by the firing pin, and ignites a powder. This is what propels the bullet 114. The powder burns and creates gas to push the bullet 114 through the bore and out the muzzle. The cartridge 100 is in essence, a shell that forms the foundation of the cartridge 100.

In some embodiments, the case 102 has a case head 104 that forms a rim and an extractor groove 106. The extractor groove 106 helps retain the cartridge 100 in alignment with the bore of the firearm. Extending from the case head 104 is a body section 108 that forms the majority of the length of the case 102. Suitable materials for the case 102 may include, without limitation, lead, steel, iron, aluminum, and metal alloys. Extending from the body section 108 are at least two shoulder angles that terminate at a neck section 112 and a throat. The bullet 114 is retained at the throat.

As discussed above, the unique aspect of the cartridge 100 is the construction of at least two shoulder angles 110*a-b* that taper from between the body section 108 and the neck section 112. The first part of the shoulder 110*a* is disposed more proximally to the case head 104, and the second part of the shoulder 110*b* is more proximal to the neck section 112. The two angles 110*a-b* are, however, integral to each other, forming a smooth taper there between. In one alternative embodiment, three or more shoulder angles of varying degrees of angles may also form between or at the ends of the shoulder.

Figure 3:
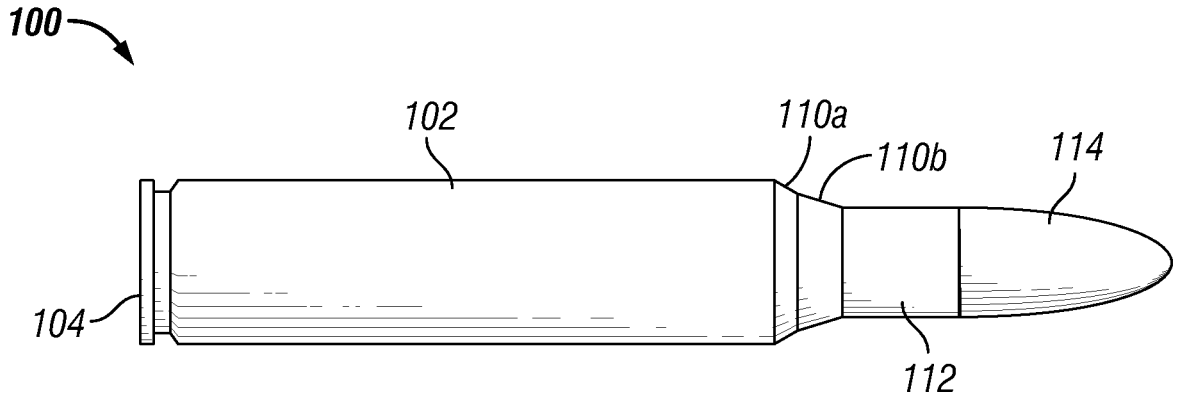
FIG. 3 illustrates a schematic view of the double shoulder angle firearm cartridge, showing dimensions of the case and double shoulder angles, in accordance with an embodiment of the present invention.

FIG. 3 illustrates a schematic view of the double shoulder angle firearm cartridge 100, showing dimensions of the case 102 and the unique angles followed by the shoulder angles 110*a-b*. As illustrated, the shoulder angles 110*a-b* are defined by at least two shoulder angles that are integral to each other, creating a continuous downward slope into the neck section 112 of the case 102. The first angle is sloped from the case head 104 to the neck section 112 from about 16° to 44°. The second shoulder angle 110*b* is sloped from the case head 104 to the neck section 112 from about 3°-30' to 31°-30'. In one non-limiting embodiment, the first shoulder angle 110*a* angle slopes from the case head 104 to the neck section 112 about 30°. And the second shoulder angle 110*b* slopes from the case head 104 to the neck section 112 about 17°-30'.

Figure 4:
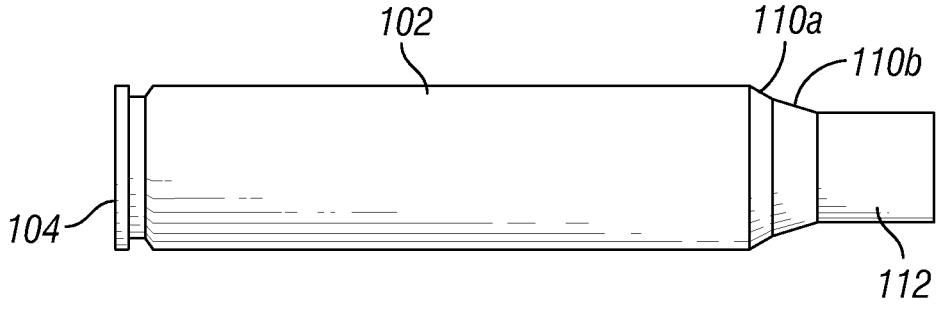
FIG. 4 illustrates yet another schematic view of the double shoulder angle firearm cartridge, showing dimensions of the case and double shoulder angles, in accordance with an embodiment of the present invention.

As FIG. 4 illustrates, the case 102 is also defined by a headspace gauge of about 7.62×39 millimeters. Those skilled in the art will recognize that headspace gauge is the distance measured from the part of the chamber that stops forward motion of the cartridge 100, as the bullet 114 is thrust forward. Further, the case 102 has a length of approximately 1.530 inches. The case 102 may also have a diameter, approximately from 0.437 to 0.454 inches. In another embodiment, the diameter of the case 102 is approximately 0.447 inches. This double-shoulder angle configuration is, however, applicable to any cartridge that has 2 or more shoulder angles, or radiuses, or any combination that can or are used to headspace off of.

The cartridge 100 is operational to fit into a standard AR-15 or bolt rifle, being interchangeable to operate in each. Once discharged, the bullet 114 travels approximately 400-700+ feet per second faster in regards to velocity, and at a faster velocity than a 7.62×39 Russian cartridge 100 known in the art. Further, the cartridge 100 is useful for both hunting and military functions. Those skilled in the art will appreciate that in other embodiments, any other firearm cartridge having two or more shoulder angles or radiuses or any combination thereof are within the scope of, and benefit from, this invention. Moreover, any firearm cartridge, barrel, or barrel chamber that can shoot the 7.62×39 Russian cartridge as well as more powerful cartridges similar to the .38 and .357 magnum cartridges, is within the scope of this invention, regardless of the number of shoulders or shoulder angles such cartridge may have.

The extractor groove 106 is used to mate with the chamber, and the case head serves as a rearward facing terminus to the cartridge. The case is wide at the middle, as is the prior art. As the case approaches the forward end, however, where the bullet resides, a first angle and a second angle form at a shoulder. This is clearly shown where the shoulder 110*a* as a 30° first angle and the second shoulder angle 110*b* as a 17° 30' angle. In any case, it is the shoulder and angles thereof that provide the greatest novelty to the present invention.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A double shoulder angle firearm and ammunition system including a cartridge for AR-15 and bolt action rifles, pistols, and other firearms, the cartridge comprising:

a case configured to hold a primer, a powder, and a bullet, the case being defined by a case head forming a rim and an extractor groove, a body section extending from the case head, a shoulder extending from the body section, and a neck section extending from the shoulder, the shoulder defined by at least two angles with a first part of the shoulder being sloped from the case head to the neck section between 16° and 44°, and a second part of the shoulder being sloped from the case head to the neck section between 3°-30' and 31°-30', the first part and the second part in an integral relationship to each other, forming a smooth taper there between, the case further being defined by a headspace gauge of 7.62×39 millimeters, the case having a length between 1.453 and 1.670 inches, and the case further having a diameter between 0.437 and 0.454 inches;

wherein the firearm includes a chamber for carrying the case during discharge.

2. The cartridge of claim 1, wherein the first shoulder angle slopes from the case head to the neck section of 30°.

3. The cartridge of claim 1, wherein the second shoulder angle slopes from the case head to the neck section between 17°-30'.

4. The cartridge of claim 1, wherein the diameter of the case is 0.447 inches.

5. The cartridge of claim 1, wherein the length of the case is 1.530 inches.

6. The firearm and ammunition system of claim 1, wherein the cartridge is a 7.62×39 millimeter Russian cartridge capable of being chambered and fired interchangeably from a firearm comprising the cartridge chamber.

7. The firearm and ammunition system of claim 1, wherein the cartridge is a .38 caliber cartridge capable of being chambered and fired interchangeably from a firearm comprising a .357 Magnum cartridge chamber.

8. The cartridge of claim 1, wherein the chamber caliber is between 0.298 and 0.317 inches in diameter.

9. The cartridge of claim 1, wherein the case is made from a metal including at least one member from a group consisting of: lead, steel, iron, aluminum, and metal alloys.

10. A double shoulder angle firearm and ammunition system including a cartridge for AR-15 and bolt action rifles, pistols, and other firearms having a case comprising a case head, a body section, a shoulder section, and a neck section, the case configured to hold a primer, a powder, and a bullet, the cartridge comprising:

the case is defined by the case head forming a rim and an extractor groove, the body section extending from the case head, at least two shoulder angles extending from the body section, and the neck section extending from the shoulder angles, the shoulder section is defined by the at least two shoulder angles tapering into each other in an integral configuration, a first shoulder angle being 30 degrees; and a second shoulder angle forming a 17° 30' sloped shoulder, the case further being defined by a headspace gauge of 7.62×39 millimeters, the case having a length of approximately from between 1.453 to 1.670 inches, and the case further having a diameter of approximately from between 0.437 to 0.454 inches; and wherein the firearm includes a chamber for carrying the case during discharge.

11. The cartridge of claim 8, wherein the second shoulder angle is substantially the same as the shoulder angle of a 7.62×39 Russian round.

12. The cartridge of claim 9, wherein starting from the case head, the body section tapers down to the first shoulder angle and then into the second shoulder angle.

13. The cartridge of claim 8, wherein the shoulder section is further defined by a third shoulder angle in an integral configuration with respect to the second shoulder angle.

14. The cartridge of claim 8, wherein the case is made from a metal including at least one member from a group consisting of: lead, steel, iron, aluminum, and metal alloys.

* * * * *